US010004325B1

(12) United States Patent
Koyzis et al.

(10) Patent No.: US 10,004,325 B1
(45) Date of Patent: Jun. 26, 2018

(54) PAINT BRUSH AND EXTENSION DEVICE ADAPTOR

(71) Applicants: Theodore Koyzis, Aurora, IL (US); Dimitrios Mastoris, Wheaton, IL (US)

(72) Inventors: Theodore Koyzis, Aurora, IL (US); Dimitrios Mastoris, Wheaton, IL (US)

( * ) Notice: Subject to any disclaimer, the term of this patent is extended or adjusted under 35 U.S.C. 154(b) by 272 days.

(21) Appl. No.: 14/945,383

(22) Filed: Nov. 18, 2015

Related U.S. Application Data

(60) Provisional application No. 62/081,682, filed on Nov. 19, 2014.

(51) Int. Cl.

| | |
|---|---|
| ***A46B 5/00*** | (2006.01) |
| ***A46B 17/02*** | (2006.01) |
| ***B25G 1/06*** | (2006.01) |
| ***B25G 3/38*** | (2006.01) |

(52) U.S. Cl.
CPC ..... *A46B 17/02* (2013.01); *A46B 5/0058* (2013.01); *A46B 5/0075* (2013.01); *A46B 5/0083* (2013.01); *A46B 5/0087* (2013.01); *A46B 5/0095* (2013.01); *B25G 1/06* (2013.01); *B25G 3/38* (2013.01); *A46B 2200/202* (2013.01); *Y10S 16/90* (2013.01); *Y10T 16/4713* (2015.01); *Y10T 16/4719* (2015.01)

(58) Field of Classification Search
CPC ..... A46B 5/00; A46B 5/002; A46B 5/0033; A46B 5/0037; A46B 5/0041; A46B 5/0045; A46B 5/0054; A46B 5/0058; A46B 5/0075; A46B 5/0079; A46B 5/0083; A46B 5/0087; A46B 5/0095; B25G 3/00; B25G 3/38; B25G 1/00; B25G 1/02; B25G 1/04; B25G 1/06; Y10T 16/4713; Y10T 16/4719; Y10S 16/90
USPC ..... 15/144.1–144.4, 145, 146, 172; 16/426, 16/427, 429, 900
See application file for complete search history.

(56) References Cited

U.S. PATENT DOCUMENTS

| | | | | | |
|---|---|---|---|---|---|
| 173,879 | A * | 2/1876 | Anderson | A47L 13/24 | 15/144.2 |
| 2,469,050 | A | 5/1945 | Mygas | | |
| 3,319,280 | A * | 5/1967 | Trachsler | A46B 17/02 | 15/146 |
| 3,357,035 | A * | 12/1967 | Ficke | A46B 17/02 | 15/144.1 |
| 3,737,187 | A * | 6/1973 | Pryor | A46B 17/02 | 15/144.1 |
| D299,693 | S | 2/1989 | Wick | | |
| 6,301,740 | B1 * | 10/2001 | Quiroz | A46B 5/0075 | 15/144.1 |

(Continued)

FOREIGN PATENT DOCUMENTS

| | | | |
|---|---|---|---|
| EP | 541138 | * | 5/1993 |
| GB | 2306908 | * | 5/1997 |

*Primary Examiner* — Mark Spisich
(74) *Attorney, Agent, or Firm* — RG Patent Consulting, LLC; Rachel Gilboy

(57) ABSTRACT

An apparatus having two elongated members with ridges joined at a rotatable joint with one elongated member adapted to be attached to a paint brush and the second elongated member adapted to be attached to an extension device. When the paint brush and extension device adaptor is used in combination with a paint brush and an extension device, the painter is able to manipulate the adaptor to reach surfaces difficult to reach using traditional methods.

7 Claims, 5 Drawing Sheets

(56) References Cited

U.S. PATENT DOCUMENTS

| | | | | |
|---|---|---|---|---|
| 7,100,238 | B2 * | 9/2006 | McCauley | A46B 5/0062 15/144.1 |
| 9,486,060 | B1 * | 11/2016 | Cara | A46B 5/0079 |
| 2002/0066151 | A1 * | 6/2002 | Parker | A46B 5/0075 15/172 |
| 2006/0207044 | A1 | 9/2006 | Ridgway | |
| 2008/0256732 | A1 * | 10/2008 | Donatelli | B25G 1/02 15/144.1 |
| 2015/0007404 | A1 * | 1/2015 | Prosser | B25G 3/38 15/144.1 |

* cited by examiner

PAINT BRUSH AND EXTENSION DEVICE ADAPTOR

CROSS-REFERENCE TO RELATED APPLICATION

The present application is related to and claims priority from prior provisional application Ser. No. 62/081,682, filed Nov. 19, 2014 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of paint brush adaptors and more specifically relates to a paint brush and extension device adaptor also referred to as a PAINTease paint brush adaptor.

2. Description of the Related Art

The term "do-it-yourself" applies in its broadest sense to a range of tasks, usually domestic projects of repair or improvement, completed by individuals who are amateurs in the field. Instead of hiring professional contractors, many homeowners enjoy the challenge of learning new skills, adapting individual styles, and incorporating materials and techniques from local sources to beautify and improve their homes. The high degree of personal satisfaction, not to mention cost-of-labor savings, provide substantial incentives to many do-it-yourselfers. A weekend painting project, for example, provides the opportunity to enhance one's self-esteem as well as reduce stress. People who do-it-themselves tend to see themselves as competent, capable, and goal-oriented.

Perhaps one of the most cost effective and personally satisfying projects for do-it-yourselfers is painting. Whether brightening the interior of a drab family room or applying a fresh coat to the exterior of a home, painting allows homeowners to express their creative ideas while beautifying their living spaces. To facilitate any particular task, painters have a variety of sizes and configurations of paint brushes specifically designed for the job at hand. From using a large, four-inch synthetic bristled brush for broad expanses of siding, wide trim, or garage doors to appropriating a compact, natural fiber, two inch trim-line for working corners and narrow edges, it is essential for painters to maintain several brushes to accommodate any painting job.

In addition, specialized rolling brushes are often employed to cover as much wall and exterior space as possible. While there is a brush for any type of painting, these tools are not equipped to reach high surfaces without the use of a ladder. As many painters would readily attest, it can be quite challenging to comfortably and accurately swipe paint along rooflines and other areas that are out of reach while balancing precariously on a ladder. Additionally, it can be exhausting and detrimental to the muscles having to contort the body to paint in awkward spots such as multi-directional walls and staircases.

Various attempts have been made to solve the above-mentioned problems such as those found in U.S. Pat. No. 2,469,050 to Mygas Nicholas; U.S. Pat. No. D299693 to David H. Wick; and U.S. Publication No. 2006/0207044 to Michael Ridgway. This art is representative of paint brush adaptors attached to an extension end. None of the above inventions and patents, taken either singly or in combination, is seen to describe the invention as claimed.

Ideally, a paint brush and extension device adaptor should provide a specially designed, adjustable, assistive apparatus used in conjunction with a paint brush and an extension device to provide professional painters and do-it-yourselfers with an easier and safer means of reaching high and awkward spots without requiring a ladder and, yet would operate reliably and be manufactured at a modest expense. Thus, a need exists for a reliable paint brush and extension device adaptor to avoid the above-mentioned problems.

BRIEF SUMMARY OF THE INVENTION

In view of the foregoing disadvantages inherent in the known paint brush adaptor art, the present invention provides a novel paint brush and extension device adaptor. The general purpose of the present invention, which will be described subsequently in greater detail is to provide an apparatus having flexible members able to be bent and shaped by a user to reach high and difficult areas with a paint brush.

A paint brush and extension device adaptor adapted to assist a user with a paint brush painting surfaces difficult to reach is disclosed herein, in a preferred embodiment, comprising a first elongated adaptor member having a brush end, a joint end, and a joint located at the joint end, and a second elongated adaptor member having a joint connector and an extension end. The brush end is adapted to receive a handle of a paint brush, the joint is adapted to fit into the joint connector, and the extension end is adapted to receive an end of an extension device.

Each of the first elongated adaptor member and the second elongated adaptor member is formed as a tubular gooseneck having ridges constructed of plastic material able to be bent and shaped via the ridges to a desired position for painting surfaces difficult to reach in a traditional manner The desired position of each of the first elongated adaptor member and the second elongated adaptor member, when manipulated, is maintained in position by rigidity created by positioning of the ridges of the first elongated adaptor member and the ridges of the second elongated adaptor member. This rigidity prevents shifting of the desired position when the paint brush and extension device adaptor is in use.

The brush end comprises a paint brush retainer having an opening measuring approximately one inch in diameter adapted to hold the handle of the paint brush. The paint brush retainer includes threading on an interior surface of the opening and is adapted to hold the handle of the paint brush in place within the opening via friction as the threading on the interior surface interacts with the handle.

The joint comprises a ball joint. The joint connector comprises a joint reception seat adapted to hold the ball joint and allow the ball joint to pivot and rotate within the joint reception seat as each of the paint brush and the extension device is being used to paint a surface. The joint connector further comprises a curved lip to hold the ball joint in place via tension as the ball joint rotates 360 degrees within the joint reception seat.

The extension end comprises an extension retainer having an opening measuring approximately one inch in diameter adapted to hold an end of an extension device. The extension retainer includes threading on an interior surface of the opening of the extension retainer. The extension retainer is adapted to hold an end of the extension device in place within the opening of the extension retainer via friction as the threading on the interior surface interacts with the end of the extension device.

The present invention holds significant improvements and serves as a paint brush and extension device adaptor. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, paint brush and extension device adaptor constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a paint brush adaptor and more particularly to a paint brush and extension device adaptor as used to improve the ability for a painter to reach high areas with a paint brush via an apparatus having flexible members able to be bent and shaped to reach difficult areas with a paint brush.

Generally speaking, the paint brush and extension device adaptor has two elongated members joined at a rotatable joint with one elongated member adapted to be attached to a paint brush and the second elongated member adapted to be attached to an extension device. When the paint brush and extension device adaptor is used in combination with a paint brush and an extension device, the painter is able to manipulate the adaptor to reach surfaces difficult to reach using traditional methods.

Figure 1:
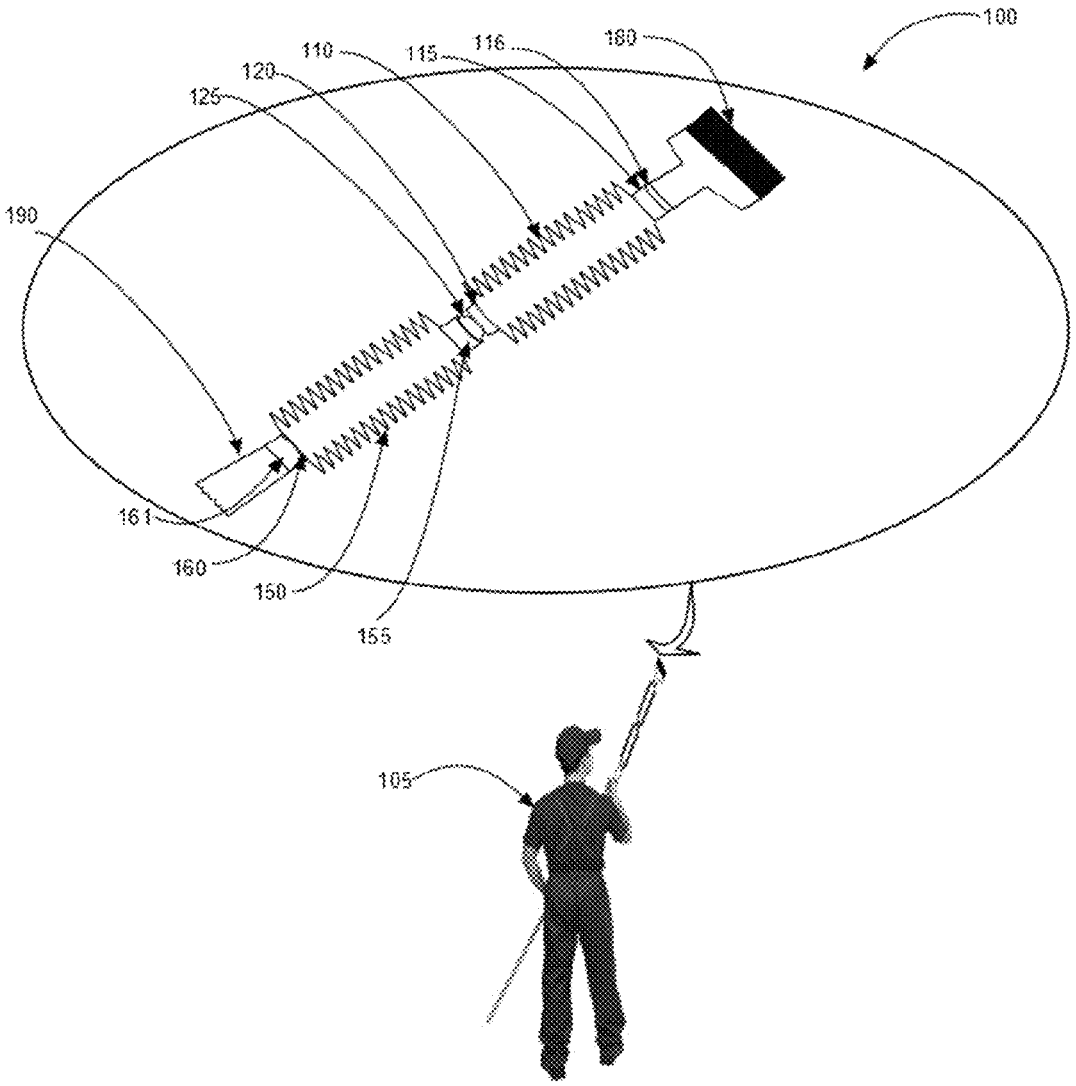
FIG. 1 shows a perspective view illustrating a paint brush and extension device adaptor in an in use condition according to an embodiment of the present invention.

Referring to the drawings by numerals of reference there is shown in FIG. 1, a perspective view illustrating paint brush and extension device adaptor 100 in an in use condition according to an embodiment of the present invention.

Paint brush and extension device adaptor 100 adapted to assist user 105 with paint brush 180 painting surfaces difficult to reach is disclosed herein, in a preferred embodiment, comprising first elongated adaptor member 110 having brush end 115, joint end 120 and joint 125 located at joint end 120, and second elongated adaptor member 150 having joint connector 155 and extension end 160. Brush end 115 is adapted to receive handle 182 of paint brush 180. Joint 125 is adapted to fit into joint connector 155, and extension end 160 is adapted to receive end 192 of extension device 190.

Figure 2:
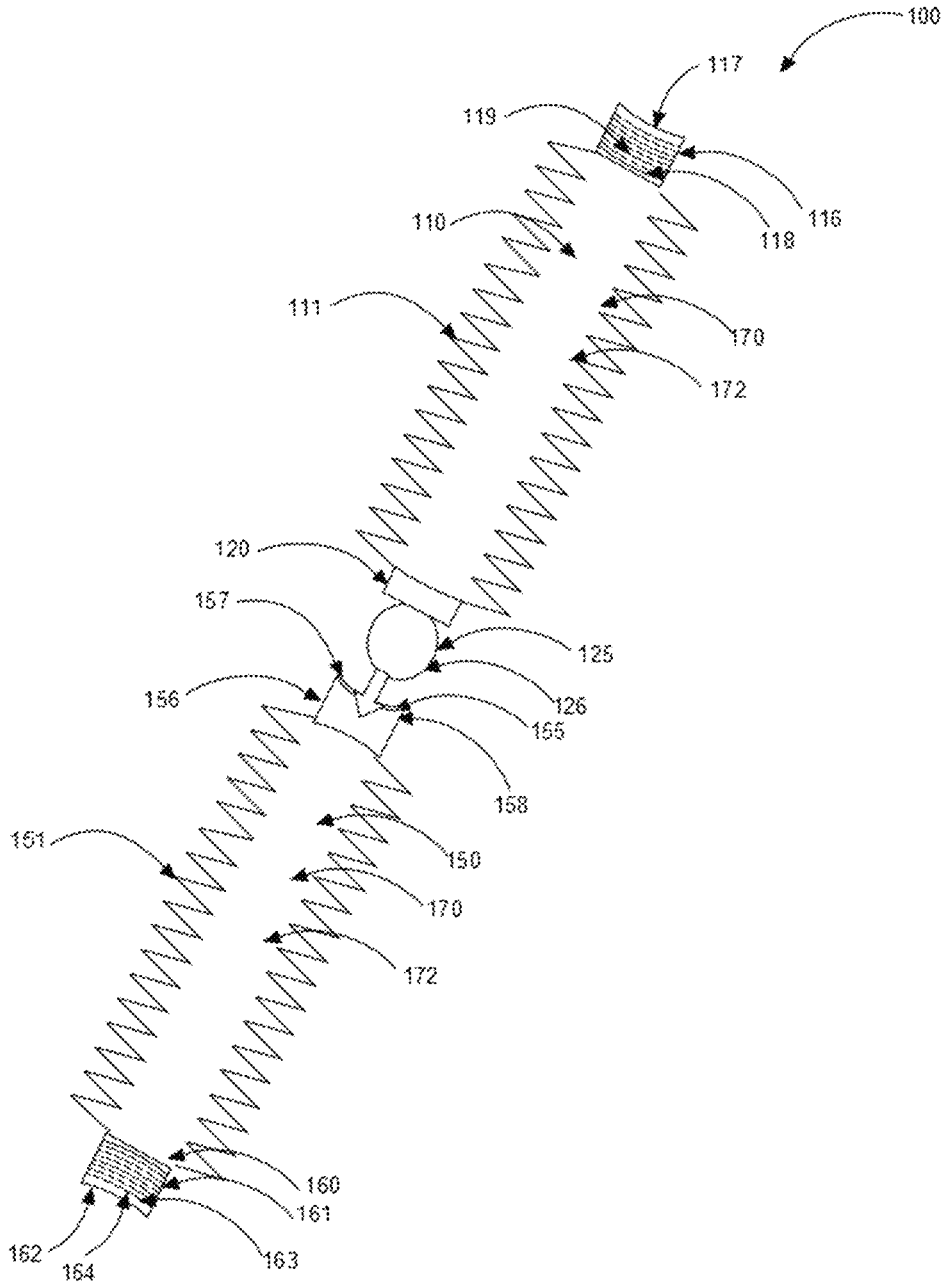
FIG. 2 is a perspective view illustrating a paint brush and extension device adaptor according to an embodiment of the present invention of FIG. 1.

Referring now to FIG. 2, a perspective view illustrating paint brush and extension device adaptor 100 according to an embodiment of the present invention of FIG. 1.

Brush end 115 comprises paint brush retainer 116 having opening 117 measuring approximately one inch in diameter adapted to hold handle 182 of paint brush 180. Paint brush retainer 116 includes threading 118 on interior surface 119 of opening 117 adapted to hold handle 182 of paint brush 180 in place within opening 117 via friction as threading 118 on interior surface 119 interacts with handle 182.

Joint 125 comprises ball joint 126. Joint 125 may also comprise any joint able to allow flexibility in adjusting the position of paint brush and extension device adaptor 100. Joint connector 155 comprises joint reception seat 156 having diameter 157 adapted to hold ball joint 126 and allow ball joint 126 to pivot and rotate within joint reception seat 156 as each of paint brush 180 and extension device 190 is being used to paint a surface. Joint connector 155 further comprises curved lip 158 to hold ball joint 126 in place via tension as ball joint 126 rotates 360 degrees within joint reception seat 156.

Extension end 160 comprises extension retainer 161 having opening 162 measuring approximately one inch in diameter adapted to hold end 192 of extension device 190. Extension retainer 161 includes threading 163 on interior surface 164 of opening 162 of extension retainer 161. Extension retainer 161 is adapted to hold end 192 of extension device 190 in place within opening 162 of extension retainer 161 via friction as threading 163 on interior surface 164 interacts with end 192 of extension device 190.

Figure 3:
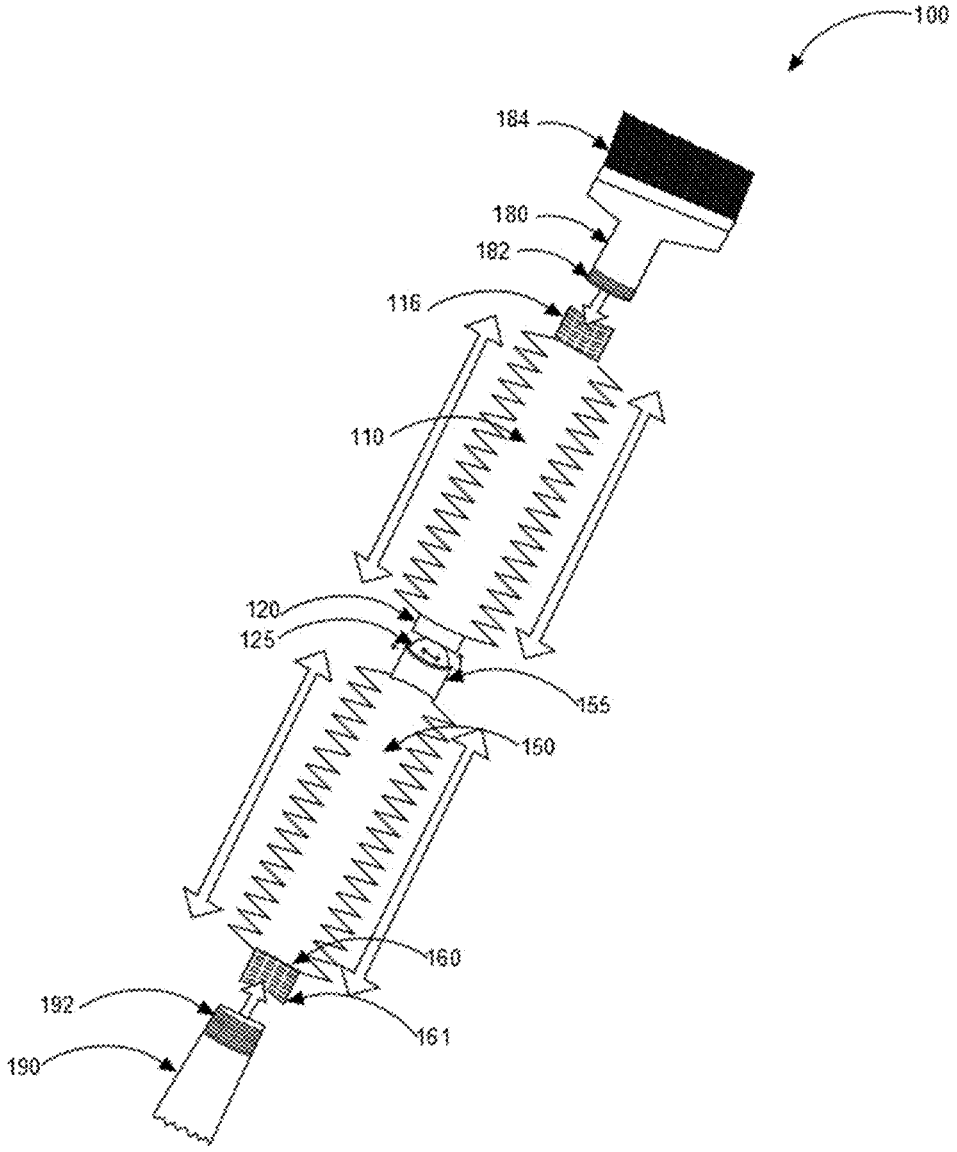
FIG. 3 is a perspective view illustrating a paint brush and extension device adaptor according to an embodiment of the present invention of FIG. 1.

Referring now to FIG. 3, a perspective view illustrating paint brush and extension device adaptor 100 according to an embodiment of the present invention of FIG. 1.

A combination of extension device 190, paint brush and extension device adaptor 100, and paint brush 180 comprises extension device 190 having extension end 192, paint brush and extension device adaptor 100 comprising first elongated adaptor member 110 having brush end 115, joint end 120, and joint 125 located at joint end 120, second elongated adaptor member 150 having joint connector 155 and extension end 160, and paint brush 180 comprising handle 182 and brush head 184. Paint brush 180 connects to first elongated adaptor member 110 at brush end 115. Second elongated adaptor member 150 connects to first elongated adaptor member 110 at joint connector 155 and extension device 190 connects to paint brush and extension device adaptor 100 at extension end 160.

Figure 4:
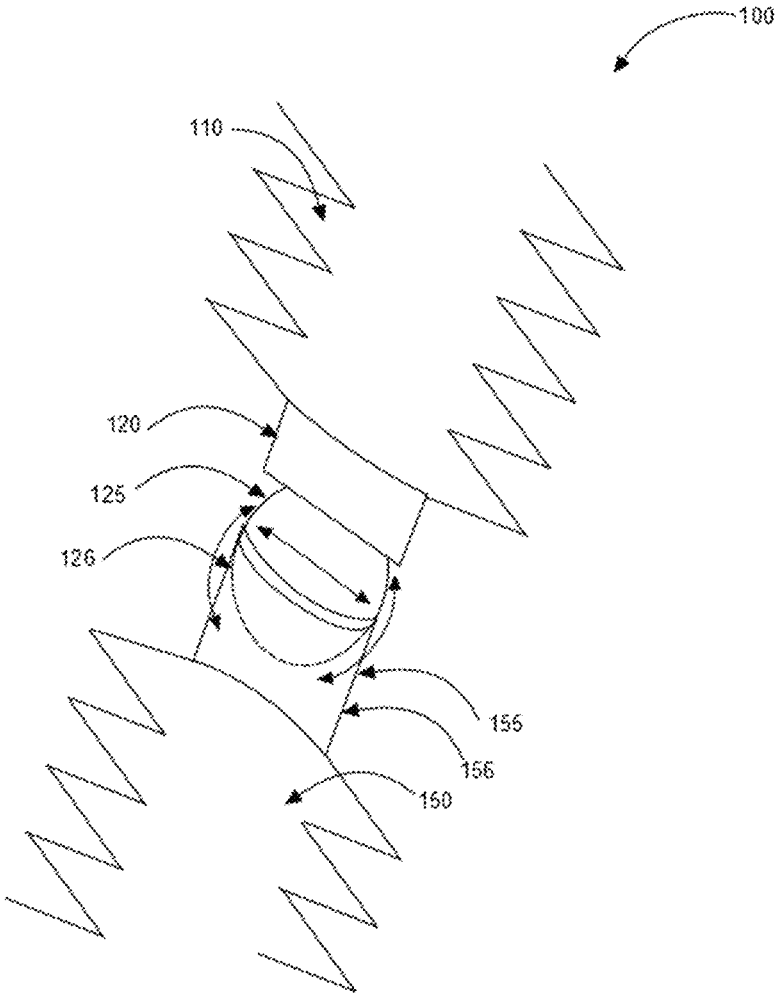
FIG. 4 is a perspective view illustrating a paint brush and extension device adaptor according to an embodiment of the present invention of FIG. 1.

Referring now to FIG. 4, a perspective view illustrating paint brush and extension device adaptor 100 according to an embodiment of the present invention of FIG. 1.

The relationship of first elongated adaptor member 110 and second elongated adaptor member 150 is able to be adjusted via joint 125 as joint 125 rotates within joint reception seat 156. Joint connector 155 comprises joint reception seat 156 having diameter 157 adapted to hold ball joint 126 and allow ball joint 126 to pivot and rotate within joint reception seat 156 as each of paint brush 180 and extension device 190 is being used to paint a surface. Joint connector 155 further comprises curved lip 158 to hold ball joint 126 in place via tension as ball joint 126 rotates 360 degrees within joint reception seat 156. Additional joints 125 with additional joint reception seats 156 may be used in alternate embodiments to provide even greater flexibility for paint brush and extension device adaptor 100.

Figure 5:
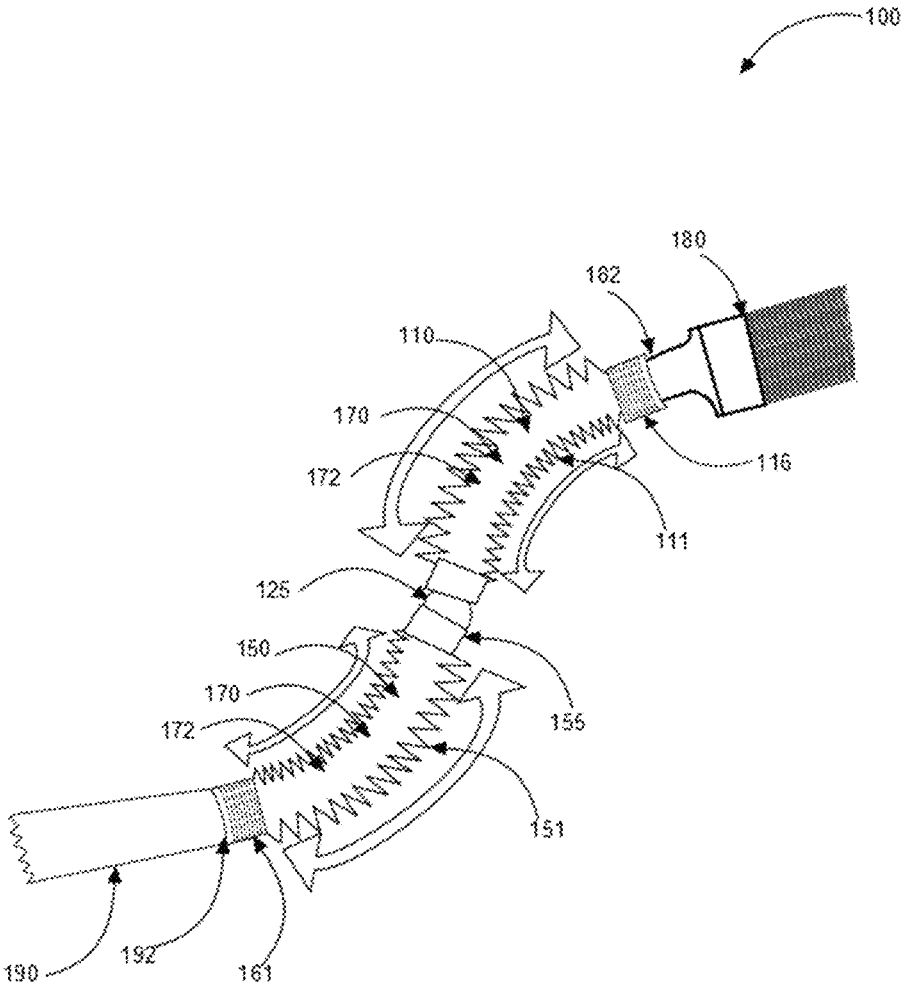
FIG. 5 is a perspective view illustrating a paint brush and extension device adaptor according to an embodiment of the present invention of FIG. 1.

Referring now to FIG. 5, a perspective view illustrating paint brush and extension device adaptor 100 according to an embodiment of the present invention of FIG. 1

Each of first elongated adaptor member 110 and second elongated adaptor member 150 is formed as tubular gooseneck 170 having ridges 111 constructed of plastic material 172 able to be bent and shaped via ridges 111 to a desired position for painting surfaces difficult to reach in a traditional manner Each of first elongated adaptor member 110 and second elongated adaptor member 150 may also be constructed of any material able to be bent and shaped in a manner to achieve the benefits of paint brush and extension device adaptor 100. The desired position of each of first elongated adaptor member 110 and second elongated adaptor member 150, when manipulated, is maintained in position by rigidity created by positioning of ridges 111 of first elongated adaptor member 110 and ridges 151 of second elongated adaptor member 150. This rigidity prevents shifting of the desired position when paint brush and extension device adaptor 100 is in use.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed:

1. A paint brush and extension device adaptor adapted to assist a user with a paint brush painting surfaces difficult to reach comprising:

a first elongated adaptor member having a brush end, a joint end and a joint located at said joint end; and a second elongated adaptor member having a joint connector and an extension end;

wherein said brush end is adapted to receive a handle of said paint brush;

wherein said joint is adapted to fit into said joint connector; and wherein extension end is adapted to receive an end of an extension device;

wherein each of said first elongated adaptor member and said second elongated adaptor member formed as a tubular gooseneck having ridges;

wherein each of said first elongated adaptor member and said second elongated adaptor member are able to be bent and shaped via said ridges to a desired position for painting said surfaces difficult to reach;

wherein said desired position of said first elongated adaptor member and said second elongated adaptor member when manipulated is held in position by rigidity created by positioning of said ridges of said first elongated adaptor member and of said ridges of said second elongated adaptor member to prevent shifting of said desired position when said paint brush and extension device adaptor is in use;

wherein said brush end comprises a paint brush retainer having an opening;

wherein said joint comprises a ball joint;

wherein said joint connector comprises a joint reception seat adapted to hold said ball joint and allow said ball joint to pivot and rotate within said joint reception seat as each of said paint brush and said extension device is being used to paint said surface;

wherein said joint connector further comprises a curved lip to hold said ball joint in place via tension as said ball joint rotates 360 degrees within said joint reception seat;

wherein said extension end comprises an extension retainer having an opening; and wherein said paint brush and extension device adaptor is individually adjustable via respective said first elongated adaptor member, said second elongated adaptor member, and said joint connector.

2. The paint brush and extension device adaptor of claim 1 wherein each of said first elongated adaptor member and said second elongated adaptor member comprises plastic material.

3. The paint brush and extension device adaptor of claim 1 wherein said paint brush retainer includes threading on an interior surface of said opening.

4. The paint brush and extension device adaptor of claim 3 wherein said paint brush retainer is adapted to hold said handle of said paint brush in place within said opening via friction as said threading on said interior surface interacts with said handle.

5. The paint brush and extension device adaptor of claim 1 wherein said extension retainer includes threading on an interior surface of said opening of said extension retainer.

6. The paint brush and extension device adaptor of claim 1 wherein said extension retainer is adapted to hold said end of said extension device in place within said opening of said extension retainer via friction as said threading on said interior surface interacts with said end of said extension device.

7. A combination of an extension device, a paint brush and extension device adaptor, and a paint brush wherein said combination comprises:

an extension device having an extension end;

a paint brush and extension device adaptor comprising;

a first elongated adaptor member having a brush end, a joint end, and a joint located at said joint end; and a second elongated adaptor member having a joint connector and an extension end; and a paint brush comprising a handle and a brush head;

wherein said paint brush connects to said first elongated adaptor member at said brush end;

wherein said second elongated adaptor member connects to said first elongated adaptor member at said joint connector; and wherein said extension device connects to said paint brush and extension device adaptor at said extension end wherein each of said first elongated adaptor member and said second elongated adaptor member formed as a tubular gooseneck having ridges;

wherein each of said first elongated adaptor member and said second elongated adaptor member are able to be bent and shaped via said ridges to a desired position for painting surfaces difficult to reach;

wherein said desired position of said first elongated adaptor member and said second elongated adaptor member when manipulated is held in position by rigidity created by positioning of said ridges of said first elongated adaptor member and of said ridges of said second elongated adaptor member to prevent shifting of said desired position when said paint brush and extension device adaptor is in use;

wherein said brush end comprises a paint brush retainer having an opening;

wherein said joint comprises a ball joint;

wherein said joint connector comprises a joint reception seat adapted to hold said ball joint and allow said ball joint to pivot and rotate within said joint reception seat as each of said paint brush and said extension device is being used to paint said surface;

wherein said joint connector further comprises a curved lip to hold said ball joint in place via tension as said ball joint rotates 360 degrees within said joint reception seat;

wherein said extension end comprises an extension retainer having an opening; and wherein said paint brush and extension device adaptor is individually adjustable via respective said first elongated adaptor member, said second elongated adaptor member, and said joint connector.

* * * * *